United States Patent [19]

Bond

[11] 4,100,593

[45] Jul. 11, 1978

[54] GAS OPERATED UNDERWATER LAMP

[76] Inventor: Joseph N. Bond, 28 Sarina Dr., Commack, N.Y. 11725

[21] Appl. No.: 752,020

[22] Filed: Dec. 20, 1976

[51] Int. Cl.[2] ..... F21V 29/00

[52] U.S. Cl. ..... 362/267; 362/294; 362/373

[58] Field of Search ..... 240/26, 47, 79; 362/267, 294, 373

[56] References Cited

U.S. PATENT DOCUMENTS

| | | | |
|---|---|---|---|
| 665,513 | 1/1901 | Dudley et al. | 240/79 |
| 2,839,673 | 6/1958 | Wilcoxon | 240/47 X |
| 3,267,277 | 8/1966 | McLamb | 240/26 |
| 3,317,723 | 5/1967 | Reinhardt | 240/47 |
| 3,614,417 | 10/1971 | Sanford | 240/26 X |
| 3,754,133 | 8/1973 | Youdin et al. | 240/47 X |
| 3,801,022 | 4/1974 | Cassey | 240/26 |
| 3,829,675 | 8/1974 | Mariani | 240/26 X |

*Primary Examiner*—Peter A. Nelson

*Attorney, Agent, or Firm*—Bucknam and Archer

[57] ABSTRACT

A gas operated underwater lamp in which the submersible housing and lens have heat transfer surfaces that cooperate with the incandescent gas burning mantle within the housing to prevent accumulation of condensate and vent the products of combustion to the atmosphere when the housing is submerged in a cooling liquid such as when used for underwater illumination of a swimming pool.

9 Claims, 5 Drawing Figures

GAS OPERATED UNDERWATER LAMP

BACKGROUND AND SUMMARY OF THE INVENTION

This invention relates in general to an underwater lamp and more particularly to a gas operated underwater lamp that can be used for underwater illumination of a swimming pool.

There are known in the prior art a variety of underwater lamps that could be used for lighting swimming pools below the water line. There are electrically operable swimming pool lamps such as is exemplified by my prior U.S. Pat. No. 3,456,103 and by U.S. Pat. No. 3,192,379 issued to R. G. M. DeGarmo.

While for the most part such electrically operated underwater lamps can provide suitable underwater illumination for swimming pools, they do present, by reason of their electrical operation, a certain electrical shock hazard. Such hazard can be regarded as more potential than actual as where a failure occurs somewhere in the insulation of the electrical supply.

Gas operated underwater lamps have been known in the prior art, as is exemplified by U.S. Pat. No. 3,267,277 issued to M. R. McLamb. While a gas lamp does not present an electrical shock hazard, the major problem associated with gas lamps is that water vapor, which is one of the products of combustion, condenses inside the water submerged enclosure. This condensation not only fogs the lens of the lamp, but it also collects in the bottom of the enclosure and ultimately extinguishes the gas lamp.

The invention provides a gas operated underwater lamp in which any condensate formed does not accumulate but instead is re-vaporized and vented to the atmosphere.

Basically the invention provides a gas operated underwater lamp which comprises a watertight housing having a frontal opening, a translucent cover disposed across said opening and covering same, said cover being connected to the housing in watertight sealed relationship therewith, at least one gas burning incandescent mantle disposed within said housing, first conduit means extending into said housing and communicating with said mantle to supply gas thereto for burning thereby, second conduit means extending into said housing and communicating therewith to vent therefrom products of combustion resulting from the burning of said gas; said housing and cover having heat transfer surfaces which cooperate with said mantle to prevent accumulation within the housing of condensate from products of combustion, when said housing is submersed in a cooling liquid.

According to a preferred embodiment of the invention the lamp has a submersible watertight housing that contains two propane gas burning mantles as sources of illumination. The front of the housing has a translucent and preferably transparent cover lens which allows light from the incandescent mantles to project into the water of a swimming pool in which the housing of the lamp is submerged. A vent pipe is connected to the top of the housing and communicates with the interior thereof thereby allowing the products of combustion to exit the housing and be vented to the ambient atmosphere at the other end of the pipe. The vent pipe preferably has an inverted U-shaped configuration which allows one end of the pipe to support the housing below the water line in the pool while the other end of the pipe is located exterior to the pool and in a free space. Thus, the vent conduit adapts the lamp ideally for use in the common above-the-ground vinyl-lined pools. The lamp of the invention has two conduits, one the vent pipe, and another which communicates with each mantle to supply gas thereto. The gas supply conduit is expediently passed length-wise through the vent conduit which allows gas supply and venting to be effected through a single opening in the housing. For better direction and dispersion of light to the pool, a reflector is mounted behind each mantle within the housing.

To solve the condensation problem that impaired operation of prior art gas burning lamps, the heat transfer in the housing and cover lens is carefully controlled. The bottom and sides of the housing and the cover lens are made so as to have a relatively low co-efficient of heat transfer. This allows these elements to become warm enough to prevent condensation or dispel any condensation that forms when the mantles are first ignited. To prevent the interior of the housing, and consequently the exiting gases, from becoming excessively hot, the top of the housing is more thermally conductive and has a higher co-efficient of heat transfer as compared to the bottom and sides of the housing. Preferably the conductive top of the housing has interior and exterior cooling fins. The interior cooling fins are placed so as to carry any dripping condensate to an underlying pan supported within the housing and heated by the mantles. This causes such condensate as may be collected from the top of the housing to be vaporized and carried out the vent conduit by the cooled gases.

Ignition of the mantles is expediently effected by an igniter that is located under one of the mantles. Such igniter is conveniently of the battery operated spark type and lights directly an adjoining mantle whereupon the second mantle is lighted from the first after the gas is turned on. Such igniter poses no safety hazard in that it is used only for turning on initial operation and need not be electrically energized once the mantles have been lighted. For ease of operation, a switch is incorporated in the gas control valve so that ignition can be effected automatically when the gas to the mantles is turned on. The electrical wiring to the igniter is preferably passed through the vent conduit to avoid the need for any additional opening through the housing that must be sealed watertight.

It is, therefore, an object of the invention to provide a lamp suitable for underwater illumination of a swimming pool and which is operated by a gas fuel, such as propane. Another object of this invention is to provide an underwater lamp which can be conveniently used for illuminating the type of pools which are elevated above the ground. A further object of the invention is to provide a gas operated underwater lamp in which condensate from gas combustion is effectively removed from the lamp.

Other and further objects and advantages of the invention will become apparent from the following detailed description and accompanying drawings exemplifying a preferred embodiment of the invention.

DESCRIPTION OF A PREFERRED EMBODIMENT OF THE INVENTION

Figure 1:
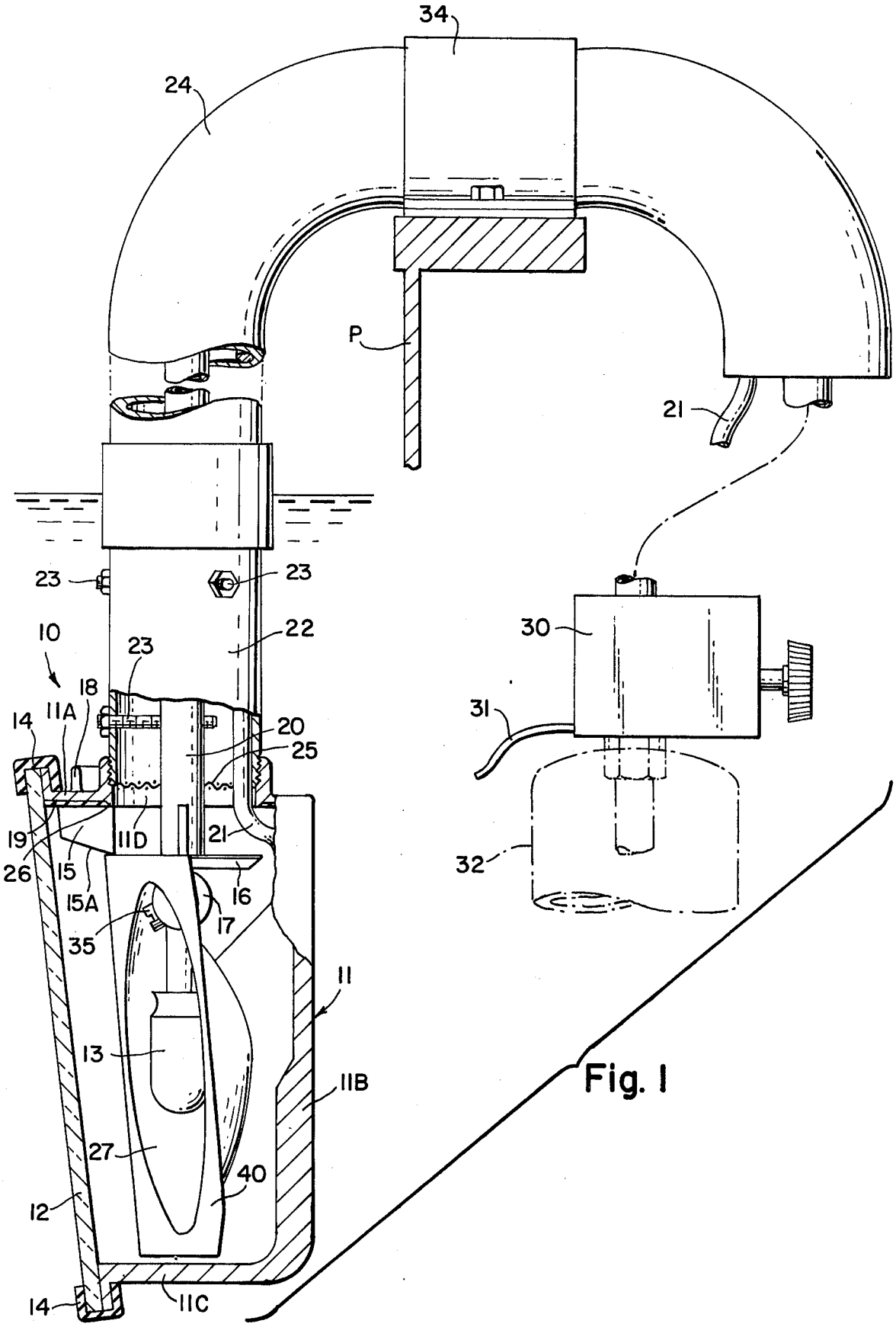
FIG. 1 is an elevation view partly in section, and partly broken away, of a gas operated underwater lamp according to a preferred embodiment of the invention as shown in a typical operating position in which the lamp housing and lens are submerged below the water line of a pool.
Figure 2:
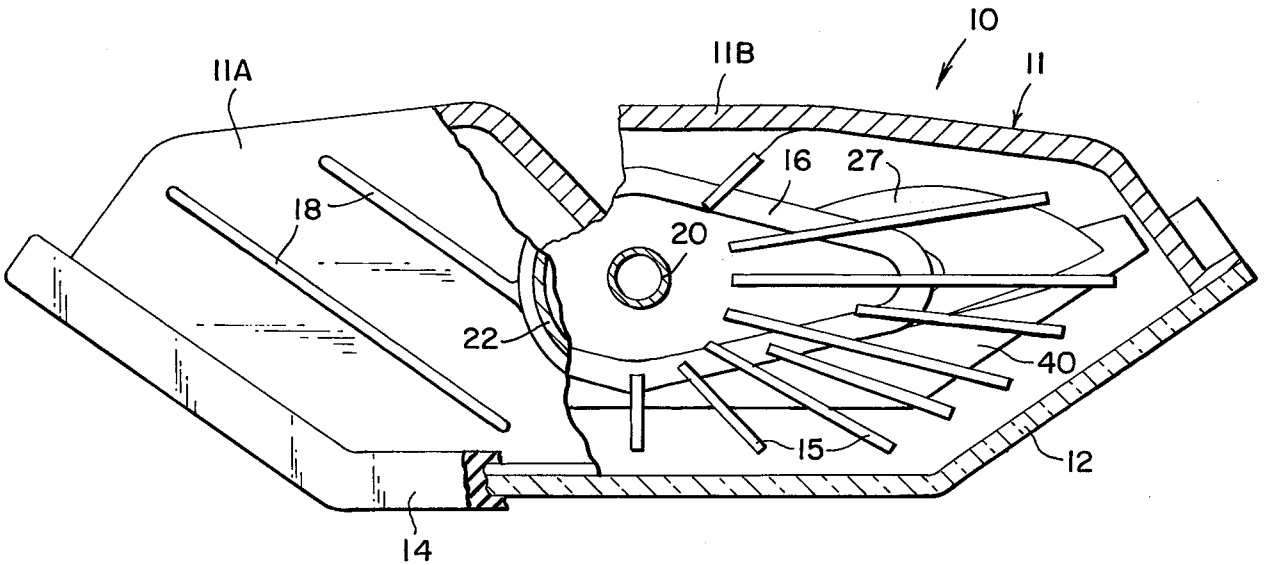
FIG. 2 is a top view of the housing portion of the lamp shown in FIG. 1 with part of the top of the housing broken away to show underlying details.

As exemplified by FIGS. 1 through 4, the invention provides a gas operated lamp 10 having a watertight housing 11 and cover lens 12. Enclosed within housing 11 are two gas operated mantles 13 which are the source of illumination. The lens 12 is made from a transparent heat resistant glass and is fastened in watertight relation to the housing by means of a seal 14. The lens thickness is such as to make it shatter resistant.

The top 11A of the housing 11 is made of a good heat conductive material such as aluminum. On its internal surface are fins 15 for removing the heat from combustion. These fins 15 are configured to urge the hot gases toward an exit opening 11D while cooling them. Because these gases contain water vapor from combustion and the fins 15 are cool, condensation occurs on the fins 15. The bottom edges 15A of the fins 15 slope downward toward the center of the housing 11. This slope carries the water droplets towards the center of the housing 11 enclosure where they drop into the vaporizer pan 16. This pan 16 is contiguous to a gas manifold 17 and is heated above the boiling point so that any condensate the pan 16 catches is re-vaporized. The re-vaporized condensate and the cooled gases then exit together. Externally located fins 18 help conduct the heat from the top 11A into the pool water in which lamp 10 is immersed.

The spaces between the internal fins 15 each have a layer of insulation 19 to prevent unwanted condensation from forming. This insulation 19 should have a coefficient of heat transfer less than 0.7 Btu/hr./sq. ft./° F. The sides 11B and bottom 11C of the housing 11 must have a low thermal conductivity so that when lamp 10 is in underwater operation, they will reach a temperature above the dew point (the temperature at which water vapor condenses.) This prevents the water vapor from condensing and collecting in the housing 11 enclosure during operation. In addition, it vaporizes any condensation which forms when the lamp 10 is first lit. The areas of sides 11B from the top to the midpoint of the reflectors 27 must have a coefficient of heat transfer less than 0.43 Btu/hr./sq. ft./° F. The areas of sides 11B from the midpoint of the reflectors 27 to the bottom 11C, and the bottom 11C itself, must have a coefficient of heat transfer less than 0.22 Btu/hr./sq. ft./° F. This can be achieved by selection of material from which the body is fabricated or by the application of insulation.

A vent conduit 24 approximately 2 inches in diameter in a typical case, is fastened to the top 11A of the housing 11 enclosure to allow the products of combustion to exit. The vent 24 is circular in cross section, and its configuration is that an inverted "U". This allows one end to support the housing 11 under the water in the pool P while the other is exterior to the pool P and protects against splashed water and rain. The vent 24 also provides a means by which the lamp 10 is mounted to the pool P with mounting clamp 34. In addition, it provides an entry to the housing 11 enclosure for a conduit 20 which carries the combustible gas to the mantles 13 and also an entry for an igniter wire 21. The portion 22 of the vent which connects directly to the top of the housing 11 is metallic. Vent portion 22 contains six screws 23 which support the gas conduit 20 and associated internal parts. In addition, being metallic and a good conductor of heat, this first section 22 of the vent gives additional cooling to the exiting products of combustion. The upper portion of the vent pipe 24 has a low thermal conductivity. It must have a coefficient of heat transfer of less than 1.2 Btu/hr./sq. ft./° F. This can typically be achieved through insulation or using a pipe with at least ⅛ inch wall thickness of a plastic such as ABS. The low thermal conductivity of this portion of the vent 24 allows it to become warm enough to prevent condensation of the exiting water vapor formed from combustion. The relatively large cross sectional area of the vent 24 is necessary to prevent explosive pressure from forming in the enclosed housing 11 in the event of delayed ignition. A metallic mesh screen 25 acts to suppress flame propagation through the vent 24 in the event of delayed ignition. A drip lip 26 is located in the top 11A of the housing 11 where it meets the vent 24. This is to assure that any condensate formed in the metallic portion of the vent will drip into the vaporizer pan 16.

Reflectors 27 are located in back of each mantle 13 so as to reflect and focus the light produced thereby, thus increasing the efficiency. The reflectors 27 are formed from sheet metal as an integral part of a dividing shield 40. This facilitates the mounting of the reflectors with screws 35 to the manifold 17 while enhancing its appearance. The bottom corners of the shield 40 have been cut off and holes 41 added in the center to increase air circulation within the housing 11. This is necessary to prevent cool spots which would allow condensation to occur.

Figure 5:
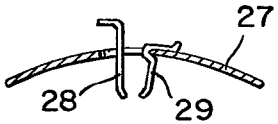
FIG. 5 is a detailed sectional view taken along line 5—5 in FIG. 3 to show details of a typical igniter that can be used for lighting the mantles of the lamp.
Figure 3:
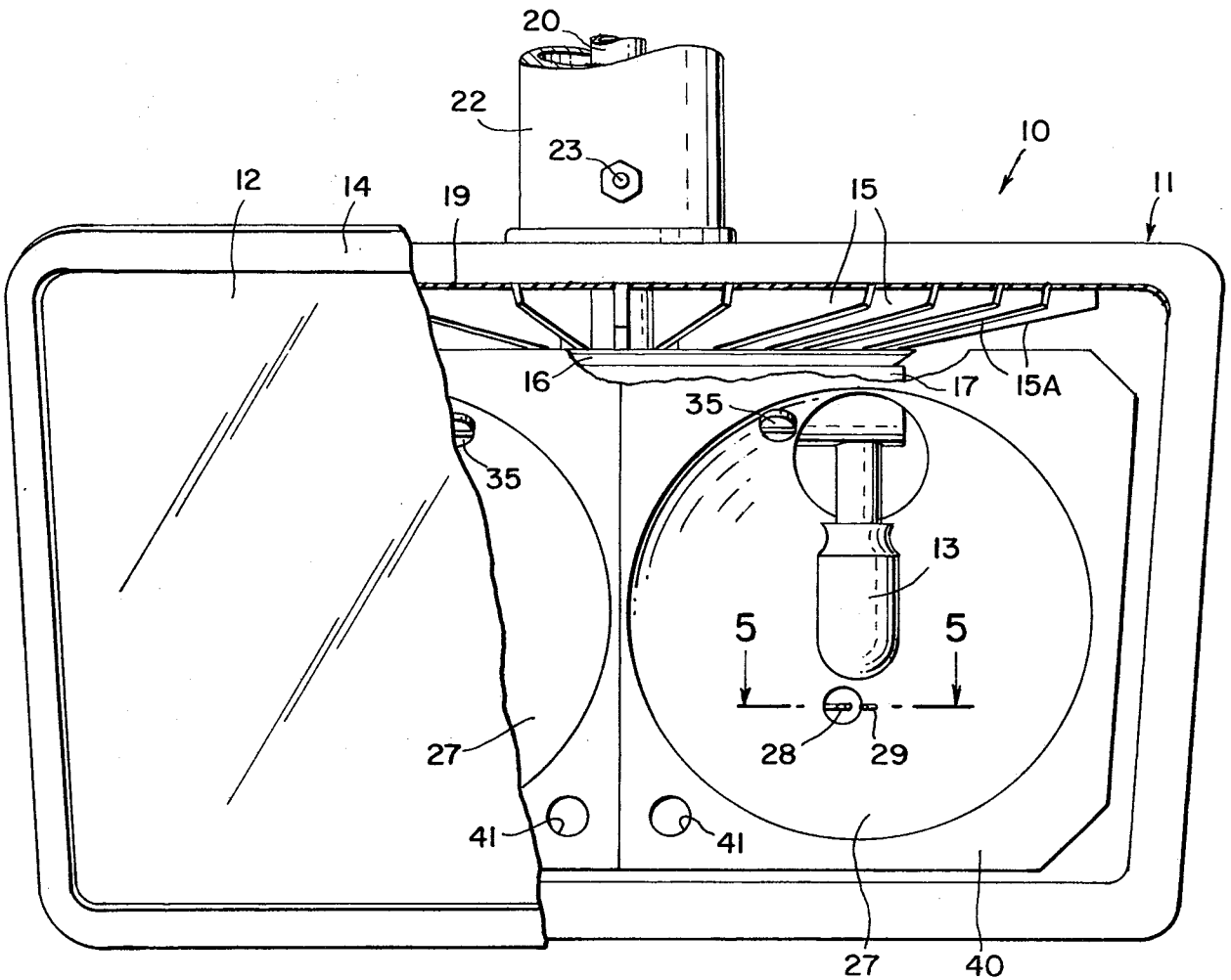
FIG. 3 is a frontal elevation view of the housing portion and the lens shown in FIG. 1 with a portion of the cover lens broken away to show interior details.
Figure 4:
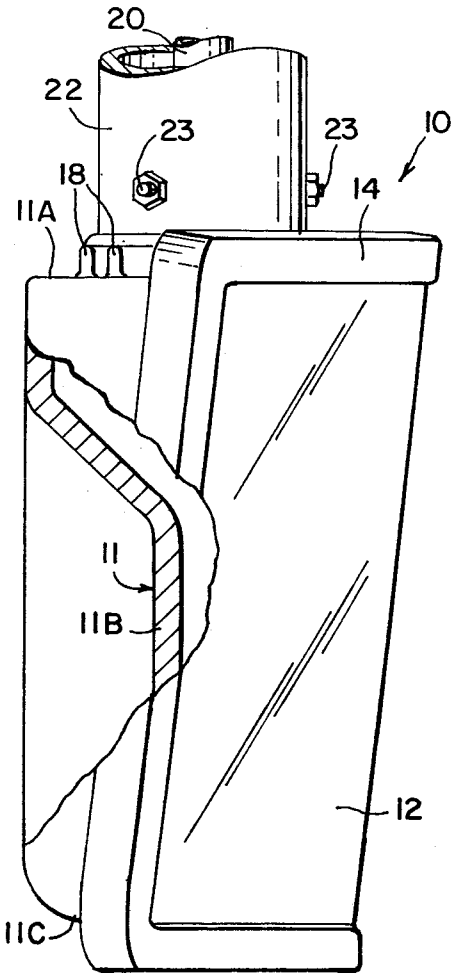
FIG. 4 is a side elevation view of the housing portion of the lamp shown in FIG. 1 with portions of the housing and cover lens broken away to show details of the back of the housing.

An electric spark igniter has been placed under one of the mantles 13. The second mantle 13 lights from the first. As shown in FIG. 5, the igniter electrode 28 passes through a hole in the reflector 27 and forms a spark gap with an electrode 29 grounded to the reflector 27. The igniter electrode 28 is connected to the insulated electrical igniter supply wire 21 which passes through the vent 24 to an igniter voltage source (not shown). The igniter voltage source, which is preferably battery operated, is activated by a switch in the gas control valve 30. This switch (not shown) is automatically actuated while the gas control valve 30 is being turned on. Igniter switch 31 connects the switch to the igniter voltage source.

The control valve 30 can either be connected to a small propane gas container 32 or a hose from a larger fuel gas container (not shown) situated elsewhere.

From the foregoing description, it will become apparent to the artisan that the invention solves the water condensation problem encountered with prior art underwater gas lamps. Basically such solution is achieved by making a lamp 10 in which the housing 11 and cover lens 12 have heat transfer surfaces which cooperate with the mantle or mantles 13 to prevent accumulation within housing 11 of condensate from products of combustion, when the housing 11 is submersed in a cooling liquid. Housing 11 has a top 11A, a bottom 11C and side wall structure that can be regarded either as a single collective side wall 11B or a group of sides walls 11B. The bottom 11C, each wall 11B and cover lens 12 have respective overall coefficients of heat transfer all of which are less than the coefficient of heat transfer at the top 11A of the housing, so that under submersed operation, the top 11A is cooler than the cover 12 and other portions 11B, 11C of the housing. Thus, any condensate that forms will form at the top 11A and will drip into pan 16 and be re-vaporized and driven out vent 24.

What is claimed is:

1. A gas operated underwater lamp which comprises a watertight housing having a frontal opening, a translucent cover disposed across said opening and covering same, said cover being connected to the housing in watertight sealed relationship therewith, at least one gas burning incandescent mantle disposed within said housing, first conduit means extending into said housing and communicating with said mantle to supply gas thereto for burning thereby, second conduit means extending into said housing and communicating therewith to vent therefrom products of combustion resulting from the burning of said gas, said housing and cover having heat transfer surfaces which cooperate with said mantle to prevent accumulation within the housing of condensate from products of combustion, when said housing is submersed in a cooling liquid, said housing having a top, a bottom and at least one side wall, said bottom of the housing, each side wall of the housing and said cover having respective coefficients of heat transfer all of which are less than the coefficient of heat transfer of the top of the housing whereby when the lamp is in operation, the top of the housing is cooler than said cover and other portions of the housing.

2. A gas operated underwater lamp according to claim 1 including a pan positioned within said housing in underlying spaced-apart relation to the top of the housing to capture condensate falling therefrom, said pan being positioned in overlying relation to said mantle for heating thereby to re-vaporize captured condensate.

3. A gas operated underwater lamp according to claim 1 including a plurality of gas burning incandescent mantles disposed within said housing, each of said mantles being in communication with said first conduit means to receive gas therefrom.

4. A gas operated underwater lamp according to claim 1 wherein said second conduit means includes a U-shaped conduit connected to the top of said housing and communicating with the interior of the housing through an opening in said top.

5. A gas operated underwater lamp according to claim 2 including a plurality of fins extending downwardly from the top of said housing and positioned to direct condensate to drip into said pan.

6. A gas operated underwater lamp according to claim 4 wherein said first conduit means includes a U-shaped conduit extending lengthwise within the U-shaped conduit of the second conduit means.

7. A gas operated underwater lamp according to claim 4 wherein said U-shaped conduit has insulation to prevent condensation of products of combustion.

8. A gas operated underwater lamp according to claim 4 including a screen positioned across said U-shaped conduit to prevent flame propagation therethrough.

9. A gas operated underwater lamp according to claim 4 including electrical igniter means disposed within said housing in proximity to a given mantle therein for igniting gas to be burned by said mantle and electrical conductor means connected to said igniter means and extending through said U-shaped conduit for connection to a source of electrical energy for activating said igniter means.

* * * * *